US008936035B2

(12) United States Patent
Wooten

(10) Patent No.: US 8,936,035 B2
(45) Date of Patent: Jan. 20, 2015

(54) OUTDOOR SHELTER SYSTEM USING WATER VESSELS FOR FRAMEWORK

(76) Inventor: Hubert Kendall Wooten, Raeford, NC (US)

( * ) Notice: Subject to any disclaimer, the term of this patent is extended or adjusted under 35 U.S.C. 154(b) by 184 days.

(21) Appl. No.: 13/556,263

(22) Filed: Jul. 24, 2012

(65) Prior Publication Data

US 2014/0026930 A1 Jan. 30, 2014

(51) Int. Cl.
*E04H 15/02* (2006.01)
*B63B 17/02* (2006.01)

(52) U.S. Cl.
CPC ..... *E04H 15/02* (2013.01); *B63B 17/02* (2013.01); *Y10S 135/905* (2013.01)
USPC ..... 135/96; 135/87; 135/137; 135/905; 114/361; 114/347

(58) Field of Classification Search
CPC ..... E04H 15/001; E04H 15/02; E04H 15/30; B63B 17/02; B63B 35/71; B63B 2017/026; B63B 25/18; B63B 19/14
USPC ..... 135/87, 95, 96, 137, 157, 115–117, 135/120.3, 901, 905, 907; 114/43, 361, 114/343–347; 5/121–123, 127–128, 5/112–116, 414–415
See application file for complete search history.

(56) References Cited

U.S. PATENT DOCUMENTS

| | | | | | |
|---|---|---|---|---|---|
| 1,322,164 | A * | 11/1919 | George | 135/95 |
| 1,531,749 | A * | 3/1925 | Kemper | 135/95 |
| 2,134,879 | A * | 11/1938 | Levy | 135/87 |
| 3,134,113 | A * | 5/1964 | Boyington et al. | 114/356 |
| 3,800,814 | A * | 4/1974 | Hibbert | 135/93 |
| 3,848,279 | A * | 11/1974 | Ipsen, Jr. | 5/113 |
| 3,971,495 | A * | 7/1976 | Velazquez | 224/154 |
| 4,272,575 | A * | 6/1981 | Egigian | 428/83 |
| 4,766,830 | A * | 8/1988 | Kunz | 114/39.26 |
| 4,979,456 | A * | 12/1990 | Steward | 114/351 |
| 5,299,522 | A * | 4/1994 | Dixon, Jr. | 114/220 |
| 5,636,478 | A * | 6/1997 | Chen | 52/2.11 |
| 5,660,137 | A * | 8/1997 | Manley | 114/361 |
| 5,740,755 | A * | 4/1998 | Nichols, Jr. | 114/343 |
| 6,623,322 | B1 * | 9/2003 | Lesniak | 441/38 |
| 6,725,798 | B1 * | 4/2004 | Hill | 114/347 |
| 7,021,235 | B1 * | 4/2006 | Nikjewicz-Larsen | 114/361 |
| 7,134,443 | B1 * | 11/2006 | Shires | 135/124 |
| 7,424,862 | B1 * | 9/2008 | Wagner | 114/361 |
| 2011/0017251 | A1 * | 1/2011 | Overbaugh | 135/90 |

* cited by examiner

*Primary Examiner* — Winnie Yip
(74) *Attorney, Agent, or Firm* — Carla Gannon Law

(57) ABSTRACT

A shelter system includes a substantially cylindrical flexible cover, and two water vessels such as canoes, kayaks or the like. The vessels are positioned along opposite walls inside the flexible cover, with the vessels and flexible covers secured so as to retain the flexible cover in a taut, oblong position. A user may use the habitat established therein as they would normally use a tent. The system may include features such as rain flaps, bug netting flaps, and flap securing means.

12 Claims, 8 Drawing Sheets

OUTDOOR SHELTER SYSTEM USING WATER VESSELS FOR FRAMEWORK

BACKGROUND (1) Field

The present invention relates generally to camping equipment, and more particularly, to a sheltering system including a flexible cover held taut by two water vessels spaced one from the other in parallel.

(2) Related Art

Camping and canoeing are very popular pastimes that allow people to enjoy the outdoors. Many enthusiasts combine the two, by canoeing to their campsite in order to access camping areas unreachable by vehicles. In this manner, one can load their canoe with camping equipment, food, water and so forth, canoe to the desired area, pull their canoe out of the water, and set up camp at that location.

The camping equipment for such excursions must be carefully selected. On one hand, one must avoid overloading their canoe with heavy and bulky items, yet must still bring equipment that provides comfort, warmth and dryness, lest the camping experience may be an unpleasant or dangerous one.

Conventional tents tend to fall into one of two categories: camping tents and backpacking tents. The former typically includes poles to form a frame, and provides the camper with a comfortable and relatively spacious shelter, yet at the expense of being both heavy and bulky when packed. Backpacking tents, on the other hand, are very light and compact, but not very comfortable or spacious. Thus, one on a canoeing/camping excursion must choose between being comfortable yet overloading their canoe, or being uncomfortable but packing reasonably.

Thus, what is needed is an outdoor shelter system that combines the comfort of a camping tent, and the packability of a backpacking tent. It is desirable that this shelter system is easy to set up and take down, and does not require special equipment. It is also desirable that this shelter system provides protection against wetness and insects, and maintains a low profile so as to be stable in windy conditions.

SUMMARY OF THE INVENTIONS

The present invention is directed to a shelter system including a flexible cover that is cylindrical in form, and two water vessels such as canoes, kayaks or the like. The shelter system is established by positioning the vessels within the cylinder, each alongside opposite inside walls with the hollow portions oriented towards each other, and increasing the distance between the vessels until the desired tautness of the flexible cover is achieved. Various components of the system are then secured in order to maintain that tautness. The end result is an oblong shaped flexible cover with a habitat inside. It is desirable that the flexible cover includes a rain flap and bug netting at the front and back open ends.

The resulting shelter system is light and compact, easy to set up and use, and especially useful for camping/canoeing excursions.

DESCRIPTION OF THE PREFERRED EMBODIMENTS

Figure 1:
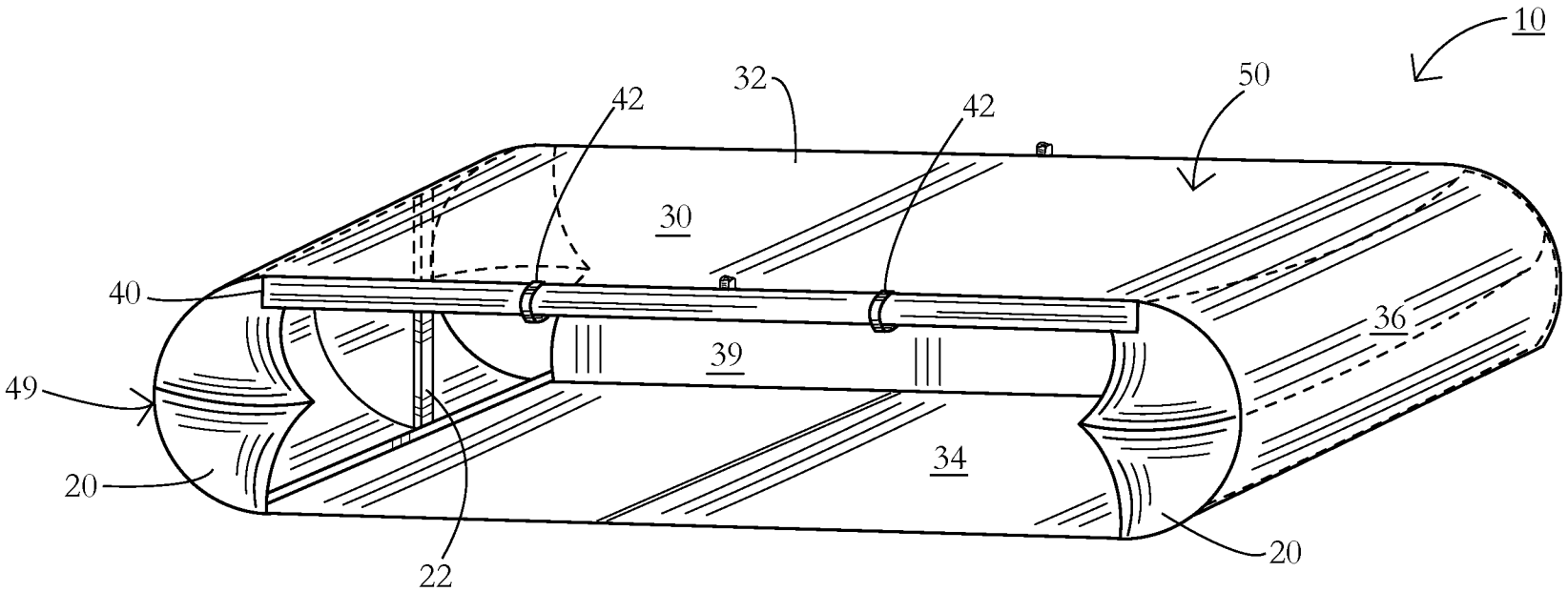
FIG. 1 is a front perspective view of an embodiment of the shelter system, with the rain flap and bug netting secured upward.

In the following description and figures, structure numbers correspond with structures as indicated:

10—Shelter system
20—Water vessel
22—Stabilizing component
30—Flexible cover
32—Upper portion
34—Bottom portion
36—Side portion
37—Back closure
38—Front opening
39—Back opening
40—Nonporous flap
41—Porous flap
42—Flap securing means
43—Tie down
44—Stake
45—Grommet
49—Front perimeter
50—Back perimeter
71—First inner wall
72—Second inner wall
81—First vessel
82—Second vessel Referring now to the drawings, it will be understood that the illustrations are for the purpose of describing a preferred embodiment of the inventions and are not intended to limit the inventions thereto. It should also be understood that, as used herein, "approximately" shall refer to +/−10%, where the value lends itself to such approximation. "Substantially" shall mean to the extent reasonably possible considering limitations such as material and human usage. For example a "substantially cylindrical" flexible cover is a cylindrical cover but not perfectly cylindrical given various seams, the propensity of material to droop, and so forth. It should also be understood that ranges include the endpoints cited, as well as all increments there between, where reasonably construed. For example, between 1" and 5" includes 1.00", 1.01" and so forth, but between 1 and 5 vessels would not be 1.01 vessels.

As shown in FIG. 1, shelter system generally includes flexible cover 30 held taut between water vessels 20. Flexible cover 30 is substantially cylindrical insofar as it forms a tube having front perimeter 49 and back perimeter 50, with the body being constructed of upper portion 32, two side portions 36, and bottom portion 34 (best shown in FIG. 2). However, it should be understood that the flexible cover would not independently maintain a cylindrical shape given the flexibility of the material and gravity.

Going clockwise from 12:00, cylindrical flexible cover 30 is constructed of upper portion 32, side portion 36, bottom portion 34, side portion 36, then returning to upper portion 32. As shown in FIGS. 1-3 and 5, flexible cover 30 appears oblong, but is cylindrical in form if not held taut by water vessels 20.

Construction of flexible cover 30 can be by connection of discrete panels connected together to form a cylinder, for example by sewing, adhesion or ultrasonic welding, or may be a solitary substrate that includes one unifying seam, for example as shown midline on bottom portion 34 (not numbered). Flexible cover 30 can be constructed of a variety of material including fabrics, plastics, and composites. It is desirable that bottom portion 34 is heavy duty and waterproof, but the remainder of the cylinder can be lightweight and waterproof. Cover 30 may optionally include structural features that protect a user from the ground, such as insulation, and water protection.

As used herein, water vessels can include canoes, kayaks, dinghies, rafts, powerboats, sailboats, personal watercraft and other water transportation devices that include a rounded bottom and area for attachment by a tie down. It should also be noted that while two water vessels are necessary, it is not necessary that those water vessels are identical. For example, one could use a kayak and a canoe, although the resulting upper portion 32 may be slanted.

Figure 2:
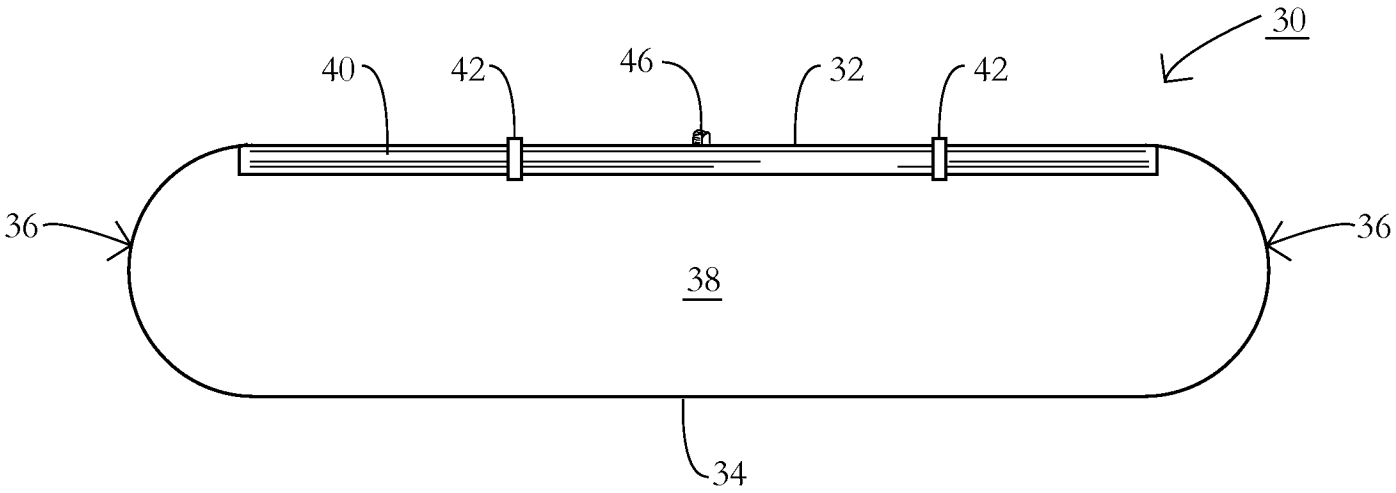
FIG. 2 is a front view of an embodiment of the shelter system.
Figure 3:
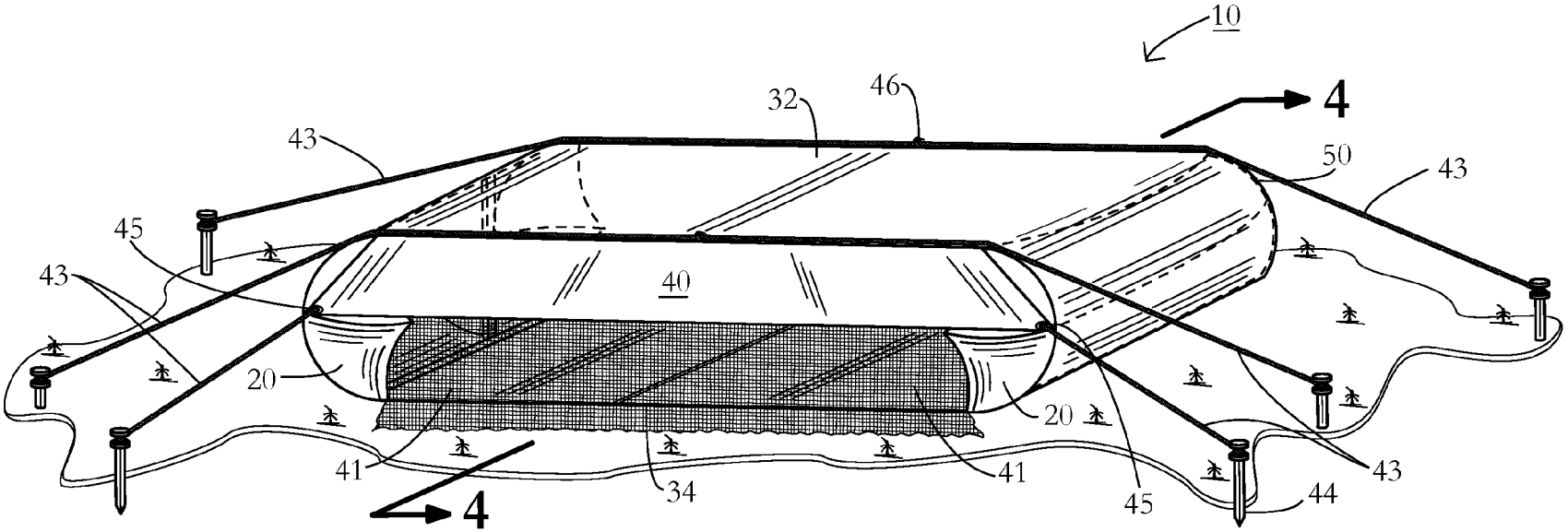
FIG. 3 is a front perspective view of an embodiment of the shelter system with the flap and netting unfurled.
Figure 5:
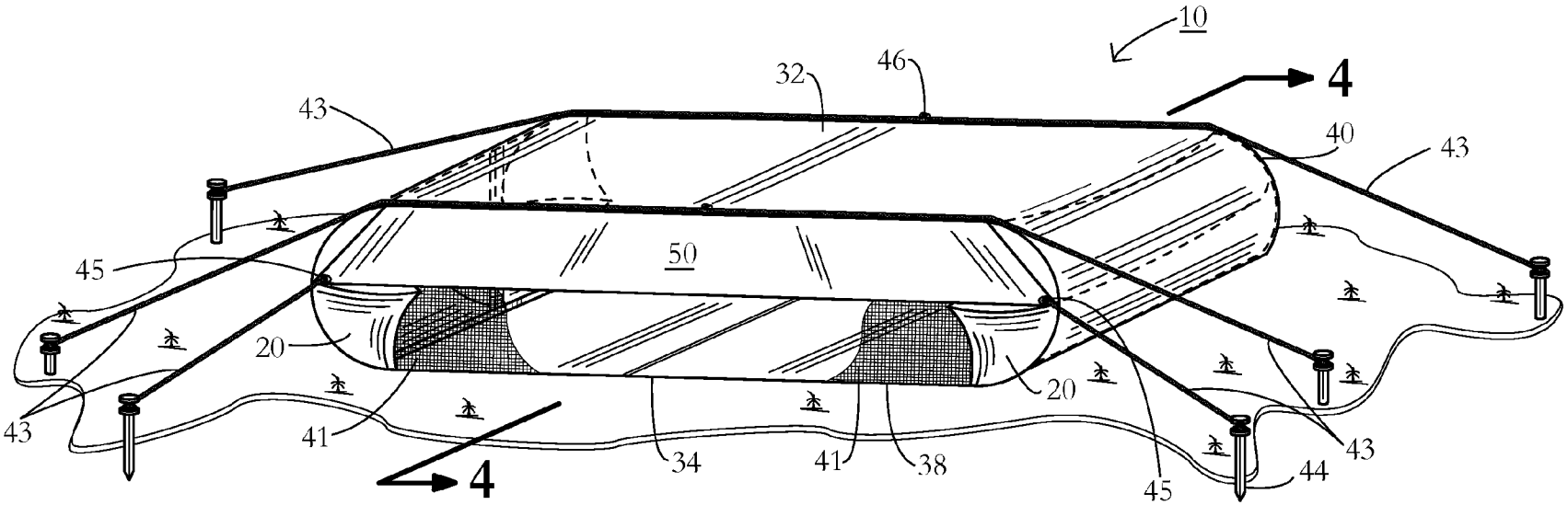
FIG. 5 is a back perspective view of an embodiment of the shelter system.

FIG. 2 depicts a direct front view of flexible cover 30, but without water vessels. It should be understood that flexible cover would not be oblong without tautness provided by water vessels. Looking directly into flexible cover 30 one peers through front opening 38, with nonporous flap 40 in furled position. In use, one can unfasten flap securing means 42 in order to allow nonporous flap 40 and porous flap 41 to unfurl, as shown in FIG. 3. An alternative embodiment is shown in FIG. 5 with flap securing means 42 at the bottom portion of flexible cover. In this embodiment flaps are secured at the bottom. Flap securing means 42 may be a tab and fastener (for example snap, tie, hook and loop, etc.) or other means known in the art for securing a flexible panel.

Nonporous flap is sized and positioned to serve as a "rain flap" by protecting front opening 38 from precipitation and other downwardly falling matter. Thus, nonporous flap 40 is desirably constructed of a water resistant substrate that is substantially nonporous. Below nonporous flap 40 is porous flap 41, which is desirably longer than nonporous flap 40 (see FIGS. 6 and 7) and capable of reaching the ground and/or connecting to bottom portion 34, so as to serve as a "bug screen". Preferably porous flap 41 is long enough that it drapes and scrunches on ground, preferably with approximately 6" of ground material, thereby forming a netting barrier to prevent flying and crawling insects, and particularly mosquitoes, from entering habitat. Porous flap 41 is desirably constructed of transparent or semi transparent netting or the like, so as to permit the ingress and egress of air, yet prevent the entrance of insects and other wildlife.

In the preferred embodiment, tie downs 43 connect vessel 20 to the ground, with stabilizing component 22 being the point of connection on the vessel. FIG. 1 depicts the gunnel as stabilizing component 22. In this manner vessel 20 is directly attached to the underlying ground by tie downs 43, which are secured by stakes 44. Thus, flexible cover 20 is secured to vessels 20 by outward force exerted by vessels, but not otherwise connected.

It is also possible to connect flexible cover 20 to vessels 30 by tie downs 43, then to connect vessels 30 to the ground by additional tie downs 43. It is also possible to connect flexible cover 30 to vessels 30 by tie downs 43, and have those same tie downs travel through grommets 45 and continue to the ground where they are staked in.

Figure 4:
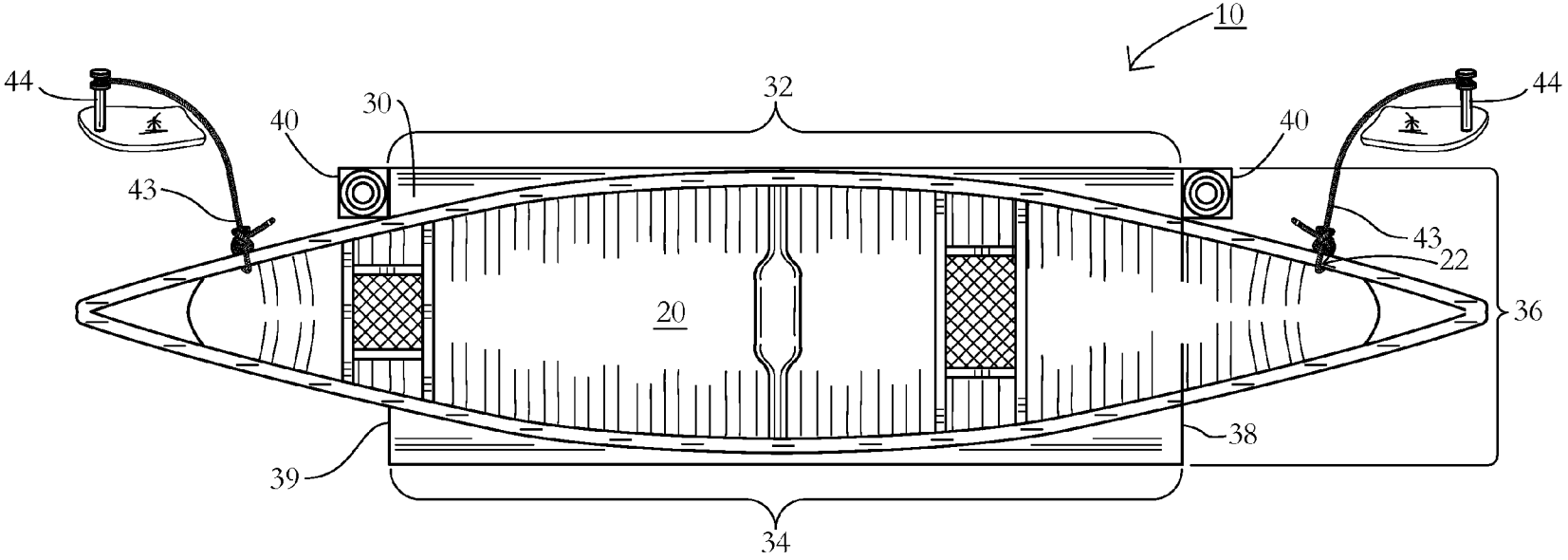
FIG. 4 is an inside view showing a flexible cover supported by a vessel.

FIG. 4 is taken along lines 4-4 of FIG. 3, and provides a view inside of shelter system 10. As shown, the open portion of the vessel hull points inward towards the habitat, whereas the bottom portion of the vessel (not shown) is in contact with the inside wall of the flexible cover. In this manner one may access the interior of the vessel while in the habitat. As used herein, "habitat" shall mean space within the shelter system that one or more persons may reasonably occupy. The dimensions of the habitat are desirably at least 8' wide, by 8' long, by 3' tall, although it should be understood that the height of the habitat is limited by the width of the vessel since the vessel on oriented on its side provides the vertical height. The appropriate dimensions of the flexible cover depend on the size of the vessels, number of people who will inhabit the system, desired spaciousness and so forth. By way of example, a flexible cover having a circumference of 42', and a width of 8' might be appropriate for accommodating a pair of vessels each having a hull with an arc length of 5', and two people with 8'×8' of space each. In this example, the circumference would be calculated as top (16')+first side (5')+bottom (16')+second side (5').

FIG. 5 is a back view, showing the alternative embodiment wherein porous flap 41 is secured by flap securing means 42, versus preferred draping and scrunching on the ground as depicted in FIG. 3. It is desirable that front and back are identical, thereby not structurally having an actual front and back. This contributes to the simplicity of the design, use and manufacturing.

Figure 6:
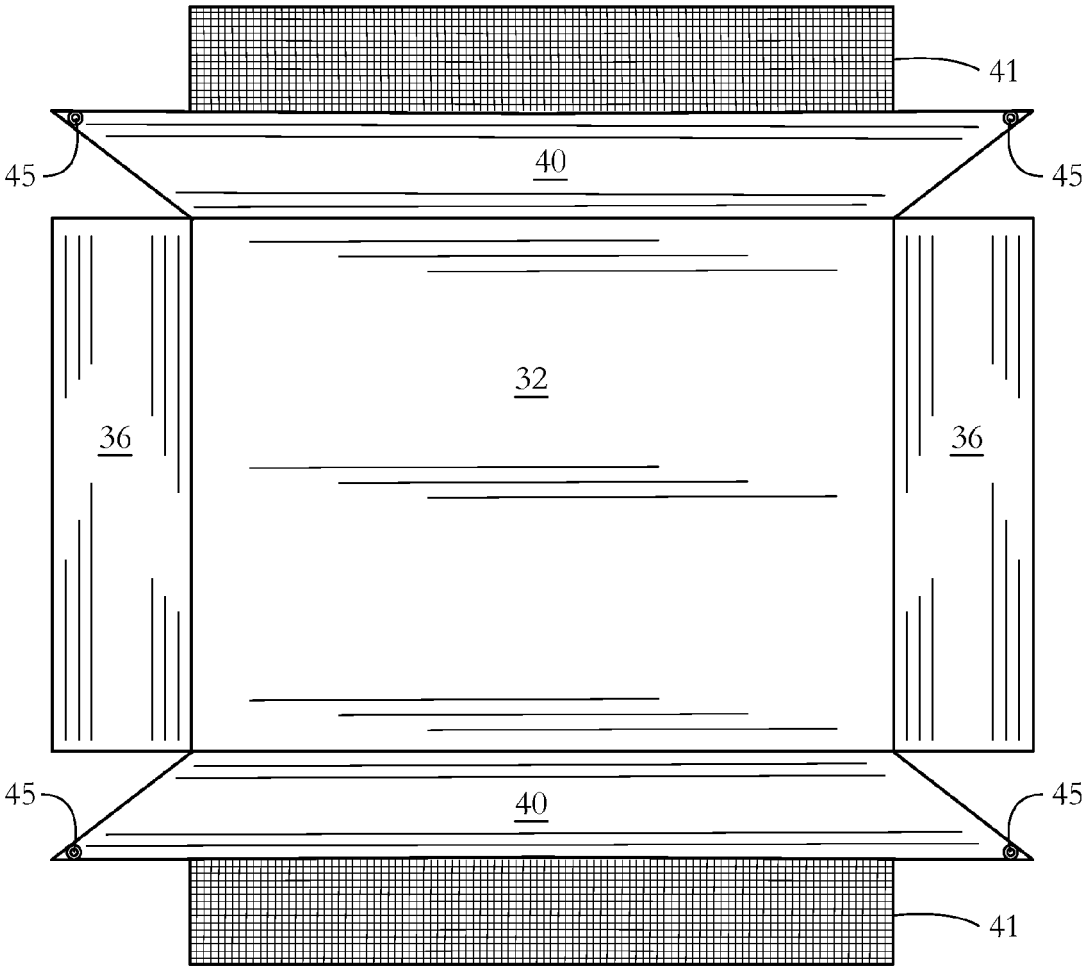
FIG. 6 is a top view of a flexible cover embodiment when laid out flat.
Figure 7:
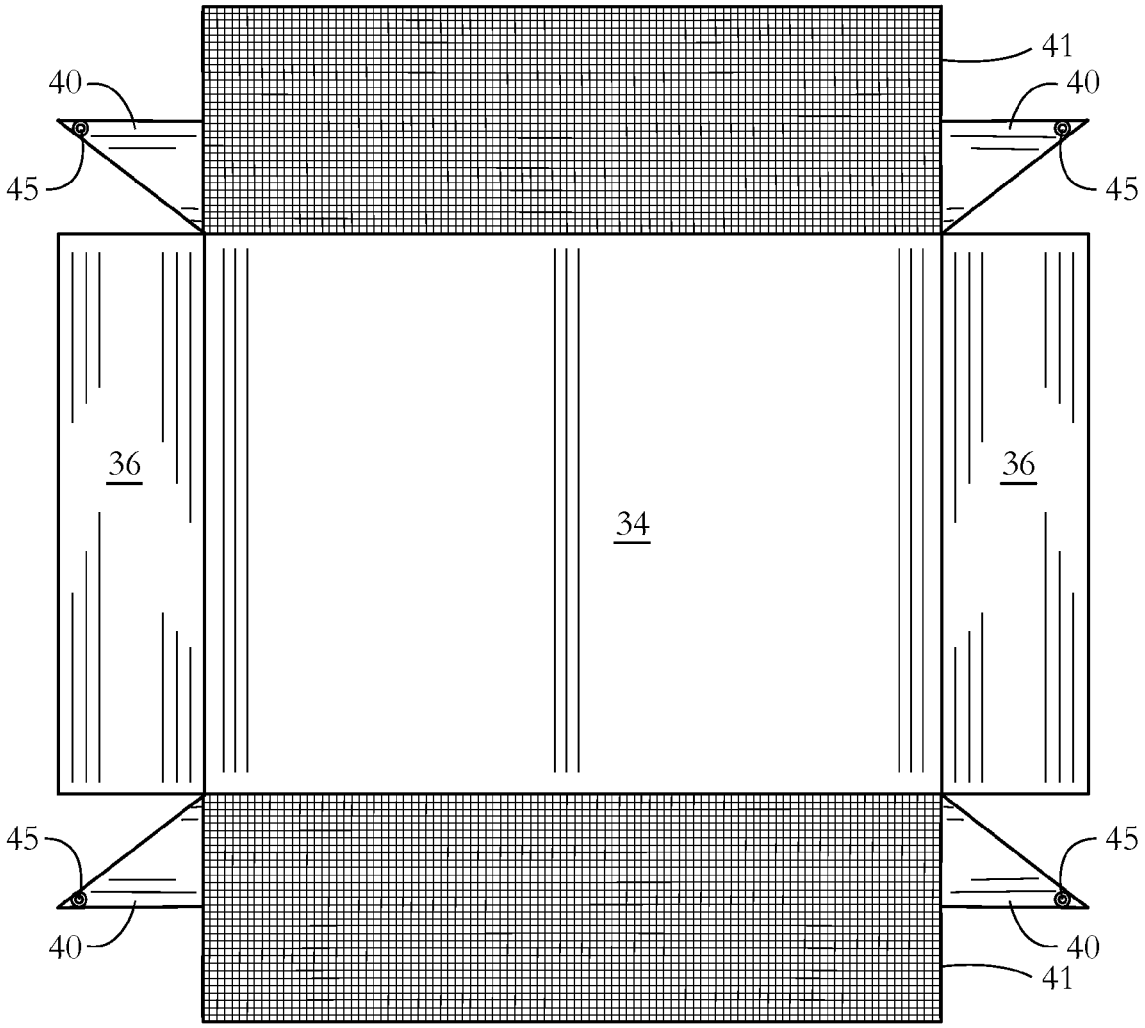
FIG. 7 is a bottom view of a flexible cover embodiment when laid out flat.

FIG. 6 depicts the top view of an embodiment of the invention if laid flat. Side portions 36 are each folded upon each other. FIG. 7 depicts the bottom view of an embodiment of the invention, as if the embodiment of FIG. 6 was flipped over without otherwise changing the position. The preferred embodiment is simply a heavy duty waterproof bottom portion 34.

Figures 8A, 8B, 8C, 8D:
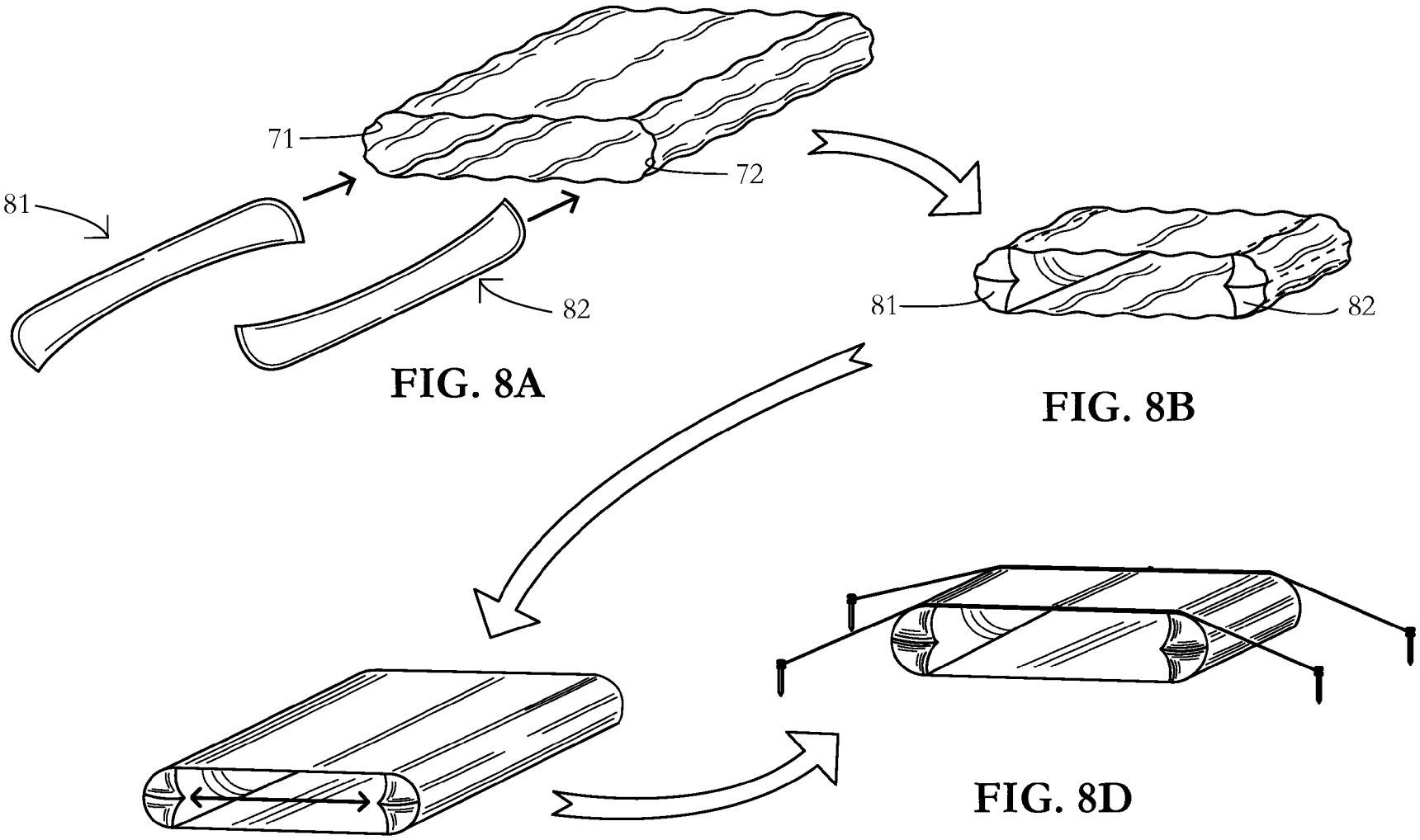
FIG. 8 schematically represents some steps of a method of setting up the shelter system with: 8A depicting the insertion of vessels into the flexible cover; 8B depicting the vessels inserted; 8C depicting the vessels moved outwardly to tauten the flexible cover; and 8D depicting the flexible cover secured to an underlying surface.

Referring to FIG. 8A, in use, one would position flexible cover 30 on an underlying surface with first inner wall 71 and second inner wall 72, corresponding to side portions 36, positioned laterally. As shown in FIG. 8B, first vessel 81 would be inserted along first inner wall 71, such that the vessel and the wall are substantially parallel. Second vessel 82 would be inserted along second inner wall 81, such that the second vessel and the second wall are substantially parallel. In this manner, first vessel 81 and second vessel 82 are substantially parallel to each other. Referring to FIG. 8C, the first and second vessels are moved outwardly relative to each other, thereby increasing the distance between them, thereby taking the slack out of the cover and creating tautness. As shown in FIG. 8D, the cover is secured to the underlying surface. As previously discussed, in the preferred embodiment the vessel is secured directly to underlying surface by stabilizing structure 22 such as gunnel or other appropriate structure.

Certain modifications and improvements will occur to those skilled in the art upon a reading of the foregoing description. For example, it would be possible to use one vessel and secure the unsupported side with tie downs and stakes. Also, it is an important component of this invention that it does not have poles or other framework that is typically used in tents. It should be understood that all such modifications and improvements have been deleted herein for the sake of conciseness and readability but are properly within the scope of the following claims.

I claim:

1. A shelter system having two water vessels as the support system, said shelter system comprising:

a. A substantially tubular flexible cover having open ends, a front perimeter and a back perimeter, said flexible cover comprising:

i. An upper portion;

ii. Two side portions connected to said upper portion; and iii. A bottom portion connected to said two side portions, said bottom portion having heavier material than said upper and side portions; and b. Two water vessels spaced one from another in parallel and proximal said two side portions, wherein force exerted outwardly on said two water vessels tautens said tubular flexible cover to provide a sheltered habitat.

2. The shelter system of claim 1 further including a substantially porous flap connected to said front perimeter.

3. The shelter system of claim 2 wherein said substantially porous flap is longer than said nonporous flap.

4. A shelter system consisting of:

a. A substantially tubular flexible cover defining a vacant space within; and b. Two water vessels each including at least one stabilizing component, said two water vessels spaced one from another in parallel, said two water vessels within said vacant space, whereby force outwardly exerted on said water vessels tautens said flexible cover thereby forming a habitat there within.

5. The shelter system of claim 4 wherein said flexible cover defines a front perimeter and a back perimeter, said habitat there between.

6. The shelter system of claim 4 wherein said two water vessels are selected from the group consisting of canoes, kayaks, dinghies, rafts, powerboats, sailboats, personal watercraft and combinations thereof.

7. The shelter system of claim 4 wherein at least one of said stabilizing components is a gunnel.

8. The shelter system of claim 4 wherein each of said at least one stabilizing component are secured to an underlying surface.

9. The shelter system of claim 8 wherein said stabilizing component is adapted to be secured to the ground.

10. A method of providing shelter comprising the steps of:

a. Positioning a substantially cylindrical flexible cover on an underlying surface, said flexible cover including a first inner wall and a second inner wall;

b. Inserting a first vessel alongside said first inner wall, said first vessel substantially parallel to said first inner wall;

c. Inserting a second vessel along said second inner wall, said second vessel substantially parallel to said second inner wall, and said second vessel substantially parallel to said first vessel;

d. Increasing the distance between said first vessel and said second vessel until said substantially cylindrical flexible cover is taut there around; and e. Securing said first vessel and said second vessel.

11. The method of claim 10 wherein said step of increasing the distance between said first vessel and said second vessel includes maintaining parallel orientation of said first vessel relative to said second vessel.

12. The method of claim 10 wherein said step of securing said first vessel and said second vessel includes the step of securing to said underlying surface.

* * * * *